US005964644A

United States Patent [19]

Rhoades

[11] Patent Number: 5,964,644

[45] **Date of Patent: *Oct. 12, 1999**

[54] ABRASIVE JET STREAM POLISHING

[75] Inventor: Lawrence J. Rhoades, Pittsburgh, Pa.

[73] Assignee: Extrude Hone Corporation, Irwin, Pa.

[ * ] Notice: This patent is subject to a terminal disclaimer.

[21] Appl. No.: 08/627,226

[22] Filed: Mar. 1, 1996

[51] Int. Cl.[6] ..... B24B 1/00; B24C 1/00

[52] U.S. Cl. ..... 451/40; 451/28; 451/39

[58] Field of Search ..... 451/41, 28, 39, 451/40, 60, 36, 38, 91; 51/306

[56] References Cited

U.S. PATENT DOCUMENTS 3,262,234 7/1966 Roach ..... 451/102
5,261,191 11/1993 Wick ..... 451/39
5,357,718 10/1994 Kanno ..... 451/39
5,545,076 8/1996 Yun et al. ..... 451/41
5,679,058 10/1997 Rhoades ..... 451/40

*Primary Examiner*—Timothy V. Eley
*Assistant Examiner*—Derris H. Banks
*Attorney, Agent, or Firm*—Waldron & Associates

[57] ABSTRACT

Abrasive jet stream polishing, wherein an abrasive is suspended in a flowable jet medium and projected at high velocity and pressure at a workpiece is provide, where the jet is projected at the surface to be polished at an oblique angle. The method is substantially improved by forming the medium of a polymer having reformable sacrificial chemical bonds which are preferentially broken under high shear conditions. Projecting the medium and suspended abrasive breaks the reformable sacrificial chemical bonds while polishing. The chemical bonds will reform, permitting recycling of the medium and abrasive for reuse in the method. The jet is effective at relatively low pressures of about 5 to about 80 MPa.

29 Claims, 2 Drawing Sheets

ABRASIVE JET STREAM POLISHING

BACKGROUND

1. Technical Field

The present invention relates to the field of jet stream polishing, coating removal and cleaning adherent materials from workpieces, and particularly to abrasive jet stream polishing, wherein a suspension of abrasive particles in a viscous medium is pumped under pressure and at high velocity against the surface of a workpiece to effect polishing and cleaning operations. Such operations are usefully employed in polishing the surfaces of of metal sheet and plate, cast and forged metal articles, and related surfaces in the fabrication of useful articles. Typical applications are the polishing surfaces of materials which are difficult to machine, such as stainless steels, titanium, nickel alloys, tungsten carbide, tool steels and the like. The technique may be employed in operations on non-metal surfaces as well, including reinforced polymer composites, ceramics, glass, rock and the like. The technique is also useful for cleaning and descaling metals, removal of paints and coatings, including ceramic coatings, from surfaces, and the like.

2. Prior Art

Polishing and related operations to smooth and finish surfaces are basic to the fabrication of metals into useful articles and have been practiced as long as the production and use of metals has been known. Indeed, in the fabrication of many metal articles, surface finishing operations represent a very substantial component of the total manufacturing operations required. Such operations, in a variety of forms and techniques, are typically labor intensive and expensive.

All such techniques, of which there are large numbers, are based on the removal of elevated portions from the surface, to a level consistent with lower portions. The removal of such elevated portions requires the performance of work on the workpiece surface. Work on lower surface portions is avoided or minimized.

Viewed in such broad terms, the most commonly employed techniques are based on mechanical working of the surfaces, by such common techniques as sanding, grinding, lapping, and the like. Chemical and electrical techniques are also known.

There is need in the art for more productive and economical polishing techniques which can be employed in less labor intensive operations, and to permit faster and more uniform production of finished workpieces with specified surface finish characteristics.

Work is often performed on metals and other materials by techniques involving propelling fluid or fluidized streams onto the surface. Among such techniques are sand blasting and related techniques, and jet stream cutting and machining, including abrasive jet stream cutting and machining.

Sand blasting is typically employed to roughen or peen surfaces or to remove rust and scale from metal surfaces and the like. Such techniques are not generally employed for polishing operations, and are typically directed to operations which produce surfaces which, in fact, do not require polishing in typical operations. Sand blasting is often used, for example, to roughen surfaces to aid in the adherence of applied coatings or adhesive bonding to such surfaces.

Abrasive water jets have grown to be widely employed in cutting and machining operations, particularly with metal sheet and plates to effect rapid and economical cutting and related forming operations. Typical applications have been the cutting of materials which are difficult to machine, such as stainless steels, titanium, nickel alloys, reinforced polymer composites, ceramics, glass, rock and the like. Such techniques are particularly advantageous to produce cutting action through very highly localized action at low average applied force, to effect cutting of such materials with minimal thermal stress or deformation, without the disruption of crystalline structure, and without delamination of composite materials.

To effect abrasive water jet cutting, a specialized nozzle assembly is employed to direct a coherent collimated high pressure stream through a small diameter orifice to form a jet. Typically, pressures of about 200 MPa (about 30,000 psi) and higher are applied to force the media through the nozzle orifice.

Typical nozzle assemblies are formed of abrasion resistant materials, such as tungsten carbide or boride. The orifice itself may be formed of diamond or sapphire.

Abrasive particles are added to the high speed stream of water exiting the nozzle orifice by directing the water stream through a "mixing tube" and introducing, abrasive particles into the tube in the region between the exit of the stream from the orifice and its entry into the "mixing tube." The mixing tube, which is typically several inches in length, is a region of contained, extremely turbulent flow in which the relatively stationary or slow moving abrasive particles are accelerated and become entrained in the high speed water stream, which may have nozzle exit velocities as high as Mach 3. The entrainimenit process tends to disperse and decelerate the water stream while the abrasive particles collide with the tube wall and with each other.

Relatively wide kerfs result from the dispersed stream, energy is wasted, and the tube is rapidly worn, even when made from abrasion resistant materials, such as tungsten carbide or Boride and the like. Some studies have shown that as much as 70% of the abrasive particles are fractured before they reach the workpiece to be cut.

In recent developments, water jets without abrasives have been thickened with water soluble polymers, which aid in obtaining and maintaining coherent jet streams, in reducing the level of misting, splashing and the like. Somewhat narrower kerfs can be achieved. Operating pressures and velocities remain quite high.

It is also known to suspend particulate abrasives in water jets, ordinarily relying on the thickening effect of the water soluble polymers to act as a suspending agent in the system. The abrasive cuts with greater efficiency than the water alone or the water with a thickening agent, but introduces an entire new spectrum of difficulties.

PROBLEMS IN THE ART

Jet stream cutting and machining operations have not been applied to polishing, and development of the technology has been focussed in directions which tend to be incompatible with the requirements of polishing operations.

Because of the high pressures and flow rates involved in jet stream cutting and machining, it is quite difficult to maintain coherent streams of the jet. While the use of thickening agents provides important improvements, such operations tend to be expensive, as neither the water not the soluble polymer is reusable, because the high shear inherent in such operations degrades the polymer; the degraded polymer remains dissolved in the water, providing waste disposal expense.

When abrasive is added to the system, for abrasive jet stream cutting and milling, the difficulties and expense are even greater.

Nozzles employed for abrasive water jet cutting operations are more complex and require ancillary equipment to add the abrasive to the stream, normally immediately adjacent the nozzle assembly or as a part of such a nozzle. The assembly includes a mixing chamber where the abrasive is introduced into the medium, a focusing tube where the stream is accelerated, and a small orifice where the flow is collimated into a coherent jet stream projected at the workpiece.

The mixing chamber and its associated hardware are complex, required by the necessity of injecting the abrasive particles into the relatively high speed stream. The mixing chamber is required to inject the particles into the interior of the flowing stream as much as possible to minimize the extent to which the interior surfaces of the mixing chamber and orifice are abraded. Because the components have widely different densities, it has generally not been possible to premix the components prior to the nozzle assembly because, even in thickened fluids, the abrasive particles tend to separate and settle at an appreciable rate. Additional thickening is not cost effective in such systems.

Uniform dispersion of the abrasive into the stream has proved elusive and inconsistent, largely attributable to the broad differences in density of the materials, the high velocity differences between the injected particles and the fast flowing stream, and the resulting need for the stream to accelerate the abrasive particles. The mixing of the particles into the medium is often incomplete and inconsistent, the acceleration requirements of the abrasive slows the flow of the medium, and the incomplete mixing introduces inconsistencies and inhomogeneities which cause divergent flows and differing trajectories of the stream or its components exiting the orifice, producing inconsistent and/or increased kerf widths and imprecise and non-uniform cut edges on the workpiece.

The mixing process causes the abrasive to produce high rates of wear in the interior of the nozzle elements, which have, as a result, a useful life measured in hours of operation under favorable conditions, and less favorable conditions can reduce nozzle and orifice life to a matter of minutes. For example, precise alignment of the nozzle and focusing tube are quite critical.

The entrainment of the particles also tend to make the jet stream divergent rather than coherent, resulting in wide kerfs and extra time and effort in the cutting operation.

When the jet stream into which the abrasive is introduced is adequately thickened, shear degradation precludes reuse of the medium, and the cost is substantial. Considerable amounts of the polymer are required to achieve adequate thickening to effectively suspend the abrasives commonly employed.

Water jet stream nozzle orifices are typically on the order of about 0.25 mm (about 0.010 in.). When an abrasive is introduced, the minimum practical mixing tube is about three times the orifice diameter, i.e., about 0.75 mm (about 0.030 in) or greater. Smaller nozzles have intolerably short service life from excessive erosion during operations. The wider nozzle produces a wider stream and cutting kerf, and requires more medium and abrasive consumption per unit of cutting.

Hollinger, et al., "Precision Cutting With a Low Pressure, Coherent Abrasive Suspension Jet," 5th American Water Jet Conference, Toronto, Canada, Aug. 29–31, 1989, have reported improved dispersions of abrasives in aqueous solutions of methyl cellulose and a proprietary thickening agent "Super Water" (trademark of Berkely Chemical Co.). Their work was based on attaining sufficient viscosities, based on the use of 1.5 to 2 weight percent of the thickeners to permit premixing of the abrasive into the polymer solutions, eliminating the need for injection of the abrasive at the nozzle. Hollinger, et al., reported that orifices as small as 0.254 mm (0.01 in.) could be effectively employed.

The work of Hollinger et al. has subsequently been enbodied in U.S. Pat. No. 5,184,434, issued Feb. 9, 1993, on an application filed Aug. 29, 1990. Crosslinking of the polymers employed is not contemplated.

See also Howells, "Polymerblasting with Super-Water from 1974 to 1989: a Review", Int'l. J. Water Jet Technol., Vol. 1, No. 1, March, 1990, 16 pp. Howells is particularly informative concerning the reasons why polymer jet stream media, with or without abrasives, has not been recycled and reused. See Pages 8 and 9.

In many contexts, the water or aqueous based systems employed in the prior art may not be used with some materials or particular workpieces where the presence of water or the corrosion it may produce cannot be tolerated. Jet stream cutting has not been applicable to such circumstances.

In all the polymer based thickened systems of the prior art, the degradation of the polymer chains by the high applied shear rates in the system has, to date, precluded effective techniques to recover and reuse the jet stream medium, resulting in substantial waste handling requirements and considerable expense for the polymer and abrasive consumed.

We have now found that many of the attributes of jet stream cutting and particularly abrasive jet stream cutting can be adapted to the the very different requirements of polishing operations, to provide a polishing and finishing technique which is highly controlled, rapid, and efficient, and which affords high productivity and economies.

OBJECTS AND SUMMARY OF THE INVENTION

It is an object of the present invention to provide a jet stream polishing medium which is effective to polish workpiece surfaces.

In particular, it is an object of the present invention to provide reusable polymer thickened jet stream premixed media which effectively suspend abrasive particles, form stable jet streams, polish with high efficiency and controlled material removal from the surfaces of workpieces, and which are reusable, and thereby reduce waste handling requirements and raw material costs.

A further object of the present invention is to provide techniques for jet stream polishing, particularly at low pressures and flow volumes.

Another object is to permit abrasive jet stream polishing using a simplified nozzle, considerably less expensive and smaller and particularly shorter than those heretofore required for conventional abrasive water jet machining and cutting.

Still another object is the provision of a low cost jet stream polishing system, based on the recirculation and reuse of the thickened jet stream medium.

In one embodiment of the present invention, it is an object of the present invention to provide non-aqueous jet stream media which permits the use of jet stream polishing operations with materials and workpieces not previously usable with jet stream polishing operations.

These and still other objects, which will become apparent from the following disclosure, are attained by forming a jet stream medium having a divergent flow which is impinged on the surface of a workpiece to expose raised surface areas to work by the fluid stream and remove such raised areas with minimal work is performed on other areas of the surface. Polishing, and even the requirements of grinding operations, including deburring, radiussing of edges and the like, can be effectively realized.

In the present invention, an abrasive jet stream, is formed and projected onto the surface of a workpiece in a fashion suitable to selectively effect work on the desired portions of the surface to effect polishing and grinding to the required or desired extent. In general, the working is at a lower rate than that employed for jet stream cutting, and employs operating conditions and techniques which are milder and less expensive to attain and employ than those ordinarily employed in jet stream techniques in the prior art.

The milder conditions and the selectivity of the operation on desired segments of the workpiece surfaces are ordinarily attained by a combination of operating parameters, including the following:

1. The jet may formed with a divergent pattern, unlike cutting operations where the maximum attainable coherence of the stream is ordinarily desired in order to focus the stream and maximize the work performed at the localized cutting area. Coherent jet streams may be of use, however, in polishing corners and areas of detail where the action of the jet stream needs to be focused in a small area.
2. The stream pressure and velocity are reduced below those typically employed for cutting operations.
3. The stream is desirably directed at the surface at an angle of greater than 45° from normal to the surface, and preferably greater than 60°, and as much as 80° to 89°, from normal, in contrast to cutting operations where the stream is typically projected at the surface at an angle of 5 to 30° from the normal to the surface.
4. The particle size of the abrasive should be the smallest size consistent with the required rate of polishing, in light of the hardness and roughness of the surface to be worked and the surface finish to be attained, in contrast to the selection criteria for cutting, which ordinarily employs the largest particle size consistent with the required kerf width to maximize the focussed work applied to the cutting action.
5. The hardness of the abrasive should be the highest value consistent with the cost of the materials and the limitations of the workpiece, in light of the hardness of the workpiece material to be polished. Cutting operations also typically employ the hardest and fastest cutting abrasive available within cost-effectiveness limits.

The jet stream of the present invention is preferably formed of a polymer having reformable, sacrificial chemical bonds, preferentially disrupted and broken during processing and polishing under high shear conditions, and which then reform to reconstitute the medium in a form suitable for recirculation in the process and reuse.

In one embodiment of the invention, the water jet stream is thickened with anionically cross-linked water soluble polymer, wherein the ionic cross-links are formed by salts of metals of Groups III to VIII of the Periodic Table.

In a second embodiment, the aqueous jet is formed of a hydrogel of a water soluble polymer, preferably cross-linked with a gel-promoting water soluble salt of a metal of Groups II to VIII of the Periodic Table. Cross-linking in such systems is based on intermolecular bonds, i.e., hydrogen bonding, between polymer molecules.

In a third embodiment, a non-aqueous medium is formed of an intermolecular bond cross-linked polymer which itself forms the jet stream. In operation, the polymer suspends the abrasive particles. The polymer may he partially broken down under the shear forces of the operation by disruption of the intermolecular bonds which produce the cross-links of the polymer. After the jet performs its work on the workpiece, the polymer is collected, the cross-linking bonds are allowed to reform, and the medium is recycled for reuse in the process. The polymer may be plasticized or thickened to control viscosity.

Smaller orifice diameters, on the order of as little as about 0.1 mm (about 0.004 in.) can be effectively employed if the particle diameter of the abrasive is sufficiently small.

DETAILED DESCRIPTION

Figure 1:
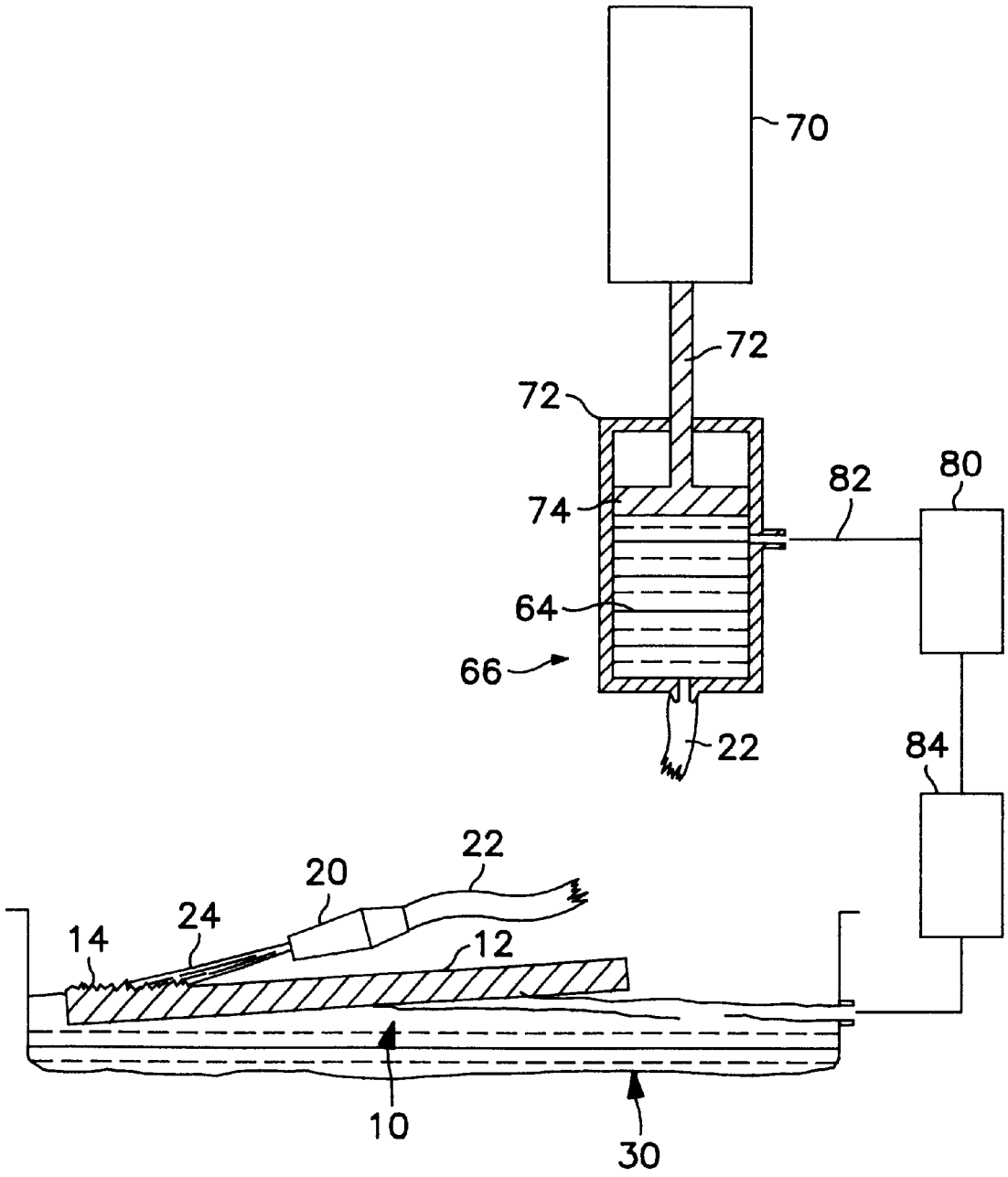
FIG. 1 is a schematic view of apparatus showing an embodiment of this invention providing recirculated media for reuse.

In the present invention, we employ a jet stream technique analogous to that employed in jet stream cutting and machining to polish and smooth surfaces of workpieces. The invention also serves to effectively perform many of the functions of grinding operations, including deburring, radiussing edges, and the like, and within limits can be employed to "grind" surfaces to required dimensions with accurate and precise tolerances.

In the present invention, a jet stream, preferably an abrasive jet stream, is formed and projected onto the surface of a workpiece in a fashion suitable to selectively effect work on the desired portions of the surface to effect polishing and grinding to the required or desired extent. While the details of the invention will vary with the nature of the polishing operation to be performed, the central thesis of polishing and grinding in the present invention is the adaptation of jet stream technology to operate with suitable selectivity on the surfaces of the workpieces to be polished, rather than focussing the stream at a single point to be cut. As a consequence of these distinctions in the nature of the process, there are significant differences in the methodology and equipment employed and in the formulation of the polishing media suitable for use in forming the jet stream.

In general, the working is at a lower rate than that employed for jet stream cutting, and employs operating conditions and techniques which are milder and less expensive to attain and employ than those ordinarily employed in jet stream cutting techniques in the prior art. In polishing operations, the removal of material is intended to be limited to the "high spots" on the surface of the workpiece, so that stock removal is limited to magnitudes consistent with the polishing or grinding functions intended.

The milder conditions and the selectivity of the operation on desired segnments of the workpiece surfaces are ordinarily attained by a combination of operating parameters, including the following:

1. The jet is preferably formed with a divergent pattern, unlike cutting operations where the maximum attainable coherence of the stream is ordinarily desired in order to focus the stream and maximize the work performed at the localized cutting area. For work in limited areas, a more focused pattern may be required, hut is generally not preferred.

In the present invention, the jet stream is relied upon to work surface areas of the workpiece rather than to focus the work at a cut to be made. In addition, the work to be performed is generally reduced, in that the amount of material to be removed from the workpiece surface is generally very small. In context, the usual collimation of the stream to focus the forces are accordingly not wanted in the operations of the present invention.

2. The stream pressure and velocity are reduced below those typically employed for cutting operations.

The high force requirements of jet stream cutting are not involved in the present invention, and the operational conditions are far milder than those employed in the prior art. As a result, less expensive equipment and materials can be employed, and the conditions and techniques of use may be less demanding of operator expertise.

3. The stream is desirably directed at the surface at an angle of greater than 45° from normal to the surface, and preferably greater than 60°, and as much as 80 to 89°, from normal, in contrast to cutting operations where the stream is typically projected at the surface at an an angle of 5 to 30° from the normal to the surface.

By directing the jet at an oblique angle to the surface, the work performed is concentrated primarily on the portions of the workpiece surface which are raised above the design surface and which are to be removed in the operation, while impingement of the jet stream on the design surface is minimized. The operation is accordingly easy to control and operate. When grinding operations are performed, to remove modest amounts of material from the entire surface to achieve dimensional changes, the obliquity of the jet lends to facilitate material removal in a fashion which is uniform, preventing the development of gouges, holes, or other surface defects and artifacts which might otherwise occur.

It is preferred to employ a jet stream containing an entrained abrasive. When an abrasive is employed, there are desirable additional parameters in the present invention:

4. The particle size of the abrasive should be the smallest size consistent with the required rate of polishing, in light of the hardness and roughness of the surface to be worked and the surface finish to be attained, in contrast to the selection criteria for cutting, which ordinarily employs the largest particle size consistent with the required kerf width to maximize the focussed work applied to the cutting action.

Since the removal of material is intended to be limited in the present invention, the selection of the abrasive is different from that to be employed in cutting. In general terms, the smaller the particle or "grit" size of the abrasive, the smoother the surface attained.

5. The hardness of the abrasive should be the highest value consistent with the cost effectiveness limits of the procedure and the hardness of the workpiece material to be polished.

As a general rule, the harder the abrasive, the faster and more efficient the polishing operation. Limiting the hardness of the abrasive may cost-effective in some cases, since, typically, the harder the material, the more expensive it is. In addition, the employment of softer abrasives limits the material removal rate, which may be desirable in limited circumstances to facilitate control.

Limiting the polishing rate is often important to provide control of the operation, as noted above. By limiting the jet stream pressure and flow rate, the surface polishing rate can be established at any value, up to a maximum, consistent with the requirements of the workpiece surface.

It is also preferred to employ a polymer based or thickened viscous medium to form the polishing jet.

The preferred embodiments of the present invention are grounded on the observation that the shear stresses imposed in the formation and use of polymer containing jet streams employed for jet stream polishing operations are necessarily high. While a number of steps can be taken to minimize the applied shear stresses in the nozzle assembly, the impact forces of the jet stream on the surface of the workpiece are also high and also break down the polymer structure. Since high shear is an inherent feature of the polishing operation, techniques for reducing polymer breakdown are, at a certain point, incompatible with the requirements of the polishing operation itself, and are thus limited.

The inclusion of one and one-half or two weight percent of thickener or polymer material in the jet stream medium typically employed in the prior art is thus a very substantial proportion of the cost of the operation. The time and energy requirements for dissolving the polymer into the aqueous medium is also a substantial factor in operating costs and can, if not adequately planned, impose substantial delays in operations because of the significant time required to dissolve such polymers. If not consistently controlled, variations in the solution may introduce a lack of uniformity in polishing and machining operations and impair the quality of the result.

After use, the degraded polymer solution is a substantial collection and handling burden on the operation, and there are no known uses for the resulting waste material. Handling and disposal costs are typically a significant cost of operations.

In that context, the employment of more complex and more expensive polymers to afford certain specific benefits to the operation are generally offset by the added costs.

The degradation of the polymers in jet stream polishing systems is produced by the breaking of the chemical bonds which make tip the polymer, and particularly the chemical bonds which form the polymer chain backbone. The result of such effects is to reduce the molecular weight of the polymer, and a consequent reduction of the viscosity and loss of the capacity of the medium to effectively suspend the abrasive particles, to form an effective jet stream, and to limit abrasive erosion of the equipment.

In the present invention, these difficulties are overcome by the employment of polymer materials which have the capacity to reform chemical bonds broken during the jet stream polishing operation, and can thus be reconstituted in a fully effective form to permit recycling and reuse. Thus, while the chemical bonds will be broken during the polishing operations, under the influence of high shear in the nozzle and by the impact on the workpiece, such effects are no longer destructive to the usefulness of the jet stream medium.

In practice, the polymers employed in the present invention may be recycled through the operation for many operating cycles. In time, there will be a more severe degradation of the chains of the polymer backbone (normally covalent bonds) which will limit the number of cycles. Generally, the preferred polymers of the present invention may be cycled through the system for twenty to one hundred cycles or more before replacement is required.

The reformation of the broken bonds to reform the polymer thickener in useful form requires that the polymer contain bonds which are sacrificed under the high shear and high impact conditions of the polishing operation, and which will reform to reconstitute the original polymer structure. This requires that the polymer contain an adequate population of chemical bonds other than covalent bonds. When covalent bonds are broken, the fragments are so highly reactive that the broken chains are normally terminated by very nearly instantaneous chain terminating reactions, and the original bonds cannot be reformed.

There are three types of chemical bonds which have thus far been evaluated in the present invention, and which have proven effective. These are ionic bonds and intermolecular B:O bonds.

Ionic bonds are frequently employed in ionic cross-linking of a variety of polymers. Such polymers are often water soluble types well suited to use in the present invention. When such polymers are ionically cross-linked, they typically form water swollen gels, having effective viscosity levels to effect highly durable suspensions of the high density abrasive particles to be added in the procedure of the present invention.

In ionically cross-linked hydrogels, the ionic bonds are weaker than the covalent bonds of the polymer backbone, and it is the ionic bonds which are preferentially disrupted and broken upon exposure to high shear stresses. The ionic species produced when the bonds are broken are relatively stable, and in the context of the polymer systems employed herein will react only to reestablish the broken cross-links, and thus reestablish the high viscosity hydrogel structure once the high shear stress is removed.

In an alternate embodiment, gel-forming water soluble polymers are formed into hydrogels, with or without gelation promoters such as water soluble salts of metals of Groups III to VIII of the Periodic Table. Hydrogels are based on the formation of intermolecular bonds, between the polymer molecules. Such bonds are weaker than ionic bonds and, in the context of the the present invention, facilitate thinning of the medium under the high shear stresses imposed in the formation of the polishing jet and providing the sacrificial bonds which protect the covalent bonds of the polymer and minimize chain scission. These hydrogels also serve to promote high viscosity at rest, whether the intermolecular bonds are formed in makeup of the gel or reformed after use, which is highly desirable in preventing settling out of the abrasive particles.

While a number of water soluble polymers have been employed in formulating jet stream polishing formulations, including some gel-forming polymers, they have been employed without gelation promoters and at concentrations at which spontaneous gelalion does not occur. The addition of such polymers in the prior art has focused mainly on increasing coherence of the jet. Without the formation of a substantial population of sacrificial bonds, the polymer is significantly degraded in a single use and is not reusable. The jet formulations of the prior art are normally discarded as waste.

Non-aqueous polymer formulations are also possible where the polymer is cross-linked by other types of sacrificial intermolecular bonds. Such formulations are particularly significant to polishing and machining materials which are vulnerable to water, such as ferrous metals and the like.

A preferred non-aqueous polymer, cross-liked and/or chain extended by intermolecular bonds, is the family of polyborosiloxanes. These polymers are cross-linked by electron pair sharing between tertiary B atoms in the polymer chain with O atoms in the chain of adjacent polymer molecules. The specific properties of significance to the present invention may be very directly and finely controlled, including molecular weight of the polyborosiloxane and the like.

The formulation of polishing media based on the use of polyborosiloxanes, as described in greater detail below, is particularly preferred in the present invention because of the non-aqueous nature of the media, the close degree of control of viscosity, and the ability to balance rest viscosity and high shear reduced viscosity to suit the requirements of the polishing and machining operations to be performed.

Intermolecular bonds, including B:O bonds, are also weaker than covalent bonds, and polymers are employed which readily form intermolecular bonds, particularly in non-aqueous jet stream processing in the present invention. Under the high shear operations involved in the production of the jet stream and under the forces of impact on workpiece surfaces, the intermolecular bonds will he broken preferentially, absorbing a portion of the energy imposed on the polymer, and preserving the covalent bonds which make up the polymer backbone.

Hydrogen bonding alone is not adequate to afford sufficient absorption of the high shear operations and preferably should be relied upon only in combinationl with other non-covalenit sacrificial bonds. Hydrogen intermolecular bonds are very weak bonds.

These intermolecular bonds will readily reform over time once the high shear stress is removed, restoring the cross-linked structure and the gel-like high viscosity required of the system.

In the context of the present invention, the cross-linking bonds, i.e., ionic or intermolecular bonds, are those first broken under the high shear and high impact conditions of the operation, and thus sacrifice themselves to absorb the energy applied. They are, in that sense, sacrificial bonds which serve to protect the covalent bonds from the degradation that would otherwise disrupt the polymer chains in permanent, irreversible fashion characteristic of the polymer degradation of the prior art materials and procedures.

The disrupted bonds will reform spontaneously when the shear stresses are removed, e.g., when the medium is allowed to stand. Breaking of the bonds converts the energy to heat, and cooling may assist in reforming the medium. The basis for the ionic bonds remains intact, as it is the ionic species characteristic of the formation of such bonds in the original polymer medium which is produced by the breaking of the bonds during operation of the jet stream polishing process. Such bonds are reversibly formed in the first instance, and exist in an equilibrium state in aqueous media in any case. The rate of reformation of the bonds is predominantly dictated by the mobility of the polymer chains in the used and degraded medium. At the reduced viscosity of the medium under such conditions, mobility is relatively substantial, and the gel will typically reform within a few minutes of collection. It is accordingly desirable to provide for mixing of the collected polymer solution and abrasive to assure the substantially homogeneous dispersion of the abrasive particles in the hydrogel, although it is also possible to re-disperse the abrasive into the reformed gel after the ionic bonds are fully restored.

The thinning of the polymer component in response to high applied shear is itself of benefit to the abrasive jet stream formation, as the formulation will show reduced viscosity in the jet stream so that the applied energy is imparted in higher proportion to the abrasive particles, enhancing their polishing effectiveness. The polymer acts to produce a highly uniform and controllable jet stream and serves to minimize abrasion within the equipment.

It is the specific viscosity parameters and changes which permit simplification of the equipment requirements, relative to prior art abrasive water jet stream techniques. Because the entrainment of the abrasive in the medium occurs at make-up in the usual mixing equipment employed, there is no need to provide a separate supply of the abrasive to the nozzle, to feed the abrasive particles into the stream, or to provide a mixing tube, all of which are normally required in the prior art.

Disrupted intermolecular bonds will spontaneously and rapidly reform, and re-dispersion of the abrasive is rather simple to effect, if required at all.

As the polymer systems are recycled through the jet stream polishing process and the reformation of the disrupted chemical bonds, there will be some disruption of covalent bonds on each cycle. Although the proportion of irreversibly disrupted bonds in each individual cycle will be modest, the effect is cumulative, and after a substantial number of cycles, the permanent degradation of the polymer will become significant. As the polymer is cumulatively and irreversibly degraded, the viscosity of the reformed polymer will gradually decline, and the medium will eventually begin to exhibit an undesirable degree of tackiness.

In the efforts to date, the polymer thickeners employed in the water jet stream polishing operations of the present invention may be successfully recycled for up to as many as one hundred use cycles before replacement is required. The non-aqueous media of the present invention are at least as durable, and often far more durable than the aqueous systems. The number of cycles will vary, of course, with the particular polymer, the process conditions, and the like, but it is readily apparent that the medium of the present invention has contributed a significant degree of recycling compared to the prior art which does not admit of reuse of the medium after a single pass through the orifice. It is generally desirable to periodically or even continuously add small quantities of "fresh" abrasive-polymer mix to maintain the consistency and uniformity of the material during use. Equivalent increments of material are desirably removed to maintain a relatively constant volume of the medium in the equipment.

Ionically cross-linkable polymers suitable for use in the present invention include any of the water soluble polymers which form ionically cross-linked gels with metal salts, metal oxides or metal organic gelation agents of Group II to Group VIII metals. Preferred species are those water soluble polymers having substantial proportions of hydroxyl groups. The polymers may also contain active ionizable reactive groups, such as carboxyl groups, sulfonic acid groups, amine groups and the like. The ionic cross-linking polymers and cross-linking systems are similar to the hydrogels formed by intermolecular hydrogen bonding, except that the ionic bonds are only formed under conditions which promote the ionization of the cross-linking species. Such conditions may require control of pH, the presence of reaction catalysts or promoters, such as Lewis acids or Lewis bases, and the like. The formation of such ionically cross-linked polymers is generally well known and characterized in the chemical literature, as those of ordinary skill in the art will understand.

A substantial number of hydrogelable polymers and gelling agents are known, and substantially any of those available may be successfully employed in the present invention.

Examples of the preferred hydroxyl group containing water soluble polymers include, but are not limited to, guar gum, xanthan gum, hydroxypropyl and hydroxyethyl derivatives of guar gum and/or xanlhan gum, and related hydroxyl group containing or substituted gums, hydroxymethyl cellulose, hydroxyethyl cellulose, and related water soluble cellulose derivatives, hydroxyl-group containing synthetic polymers, such as hydroxyethyl methacrylate, hydroxypropyl methacrylate, and other water soluble polymers, such as polyacrylamide, and the like. Also of interest are hydroxyl group terminated, water soluble species of low molecular weigh polymers and oligomers, such as polyethylene oxide, polyoxymethylene, and the like.

Among the preferred gelling promoters of Group II to Group VIII metals that may be employed are boric acid, sodium borate, and metal organic compounds of titanium, aluminum, chromium, zinc, zirconium, and the like.

A particularly preferred species for the modest cost requirements is a sodium borate gelled solution of about 2 to 2.5 weight percent guar gum in water. This particularly inexpensive hydrogel has demonstrated a capacity to survive up to twelve cycles of jet stream polishing operations at 14 MPa followed by gel reformation with no detectable permanent degradation of the polymer gel.

A preferred non-aqueous intermolecular bond cross-linked polymer is afforded by a composition of polyborosiloxane polymer, a hydrocarbon grease or oil extender or diluent, and plasticizer such as stearic acid or the like, having an effective jet stream viscosity. The polyborosiloxane polymers as a class are strong intermolecular bonding species and, when suitably plasticized to viscosities suitable for jet formation, are an excellent jet stream medium for water sensitive applications. In addition, the polyborosiloxane formulations are generally non-tacky, non-adherenl materials which are readily removed from the surface of workpieces after the polishing operation is completed.

The borosiloxane polymers for use in the present invention will generally have molecular weights from about 200,000 up to about 750,000, preferably about 350,000 to about 500,000. The atomic ratio B:Si will preferably be in the range of from about 1:3 up to about 1:100, preferably from about 1:10 up to about 1:50.

The borosiloxanes are highly compatible with a wide variety of fillers, softeners and plasticizers. It is common to employ inert fillers as diluents to reduce materials costs, and to employ suitable plasticizers and softeners to further dilute the polymer and to control viscosity.

In the present invention, the abrasive particles will ordinarily be the sole inert filler, although other fillers may be employed if the amount of abrasive is correspondingly reduced. As noted above, the abrasive (and other filler, if employed) may range from about 5 to about 60 weight percent of the formulation, while about 25 to 40 weight percent is generally preferred.

Plasticizers and softening diluents are employed to regulate the viscosity of the abrasive jet medium. Suitable plasticizers for use in silicone polymers are quite numerous and well known in the art and the selection of suitable viscosity controls is not narrowly significant to the present invention. Suitable materials include, by way of example and not by limitation, fatty acids of from about 8 to 30 carbon atoms, particularly about 12 to 20 carbon atoms, such as palmitic acid, stearic acid and oleic acid; hydrocarbon paraffin oils, particularly light oils such as "top oil" and other petroleum distillates and by-products; vegetable oils and partially or fully hydrogenated vegetable oils such as rapeseed oil, safflower oil, soybean oil and the like; hydrocarbon-based greases such as automotive lubricating greases and the like; mono-, di-, and tri-esters of polyfunctional carboxyllic acids such as dioctyl phthalate (DOP), diisononyl phthalate (DINP) and the like. Liquid or semi-solid silicone oils may also be employed, and may confer considerable benefits, despite their cost, when the medium will be subjected to high temperatures and/or oxidizing conditions which may degrade hydrocarbon based plasticizers and diluents.

As mentioned, the plasticizers and softening diluents are added to control viscosity of the formulation. A standing or rest viscosity of typically about 300,000 cps at ambient conditions, as measured by a Brookfield viscosimeter is suitable and convenient. As is well know, borosiloxane polymers exhibit a substantial apparent increase in viscosity in response to applied shear, and even exhibit plug flow through configured flow paths at high shear. While there is no available technique for direct measurement of viscosity in the nozzle of the present invention, we have found that formulations with standing viscosities of from about 200,000 cps to about 500,000 cps are generally suitable and a viscosity of about 300,000 is quite reliable. We have calculated effective viscosity as a function of the applied pressure and resulting jet stream volumes and believe the effective specific viscosity at the nozzle is on the order of about 5,000 poise to about 20,000 poise.

When the jet stream material is collected and allowed to stand, the viscosity rapidly returns to substantially the original standing viscosity, typically within five minutes or less, often within one minute. We believe that the return to the original viscosity demonstrates the reformation of the intramolecular B:Si bonds and the relatively insignificant level of chain scission.

While there will be some degradation over a number of use cycles, the level does not become significant until, typically, 20 or more cycles, and may not be notable until 100 cycles or more of use have occurred. The long-term degradation is readily offset by the periodic or continuous addition of fresh, unused media and withdrawal of an equivalent amount of spent media. Such a procedure also serves to replace worn abrasive particles with new, sharp particles, and to limit the accumulation of polishing or machining debris in the medium.

In the present invention, injection of the abrasive at the nozzle is not preferred, and is generally not desired. It is preferred that the abrasive particles be mixed into the gelled polymer in a separate, prior operation, and pumped by a suitable high pressure pump to the nozzle.

In the aqueous hydrogel systems, the polymer and its gelling agent will typically be on the order of from about 1 to about 20 weight percent of the medium, most often about 2 to 5 percent, and typically, for most polymers, about 2 to 3 percent. The exact proportions can be optimized for any particular gel in relation to the particular abrasive, its particle size and density, and the proportion to be added.

The abrasive will most often have a particle size of from as low as about 2 micrometers up to about 1400–1600 micrometers (about 16 mesh). More commonly, the abrasive grain size will be in the range of from about 20 to about 200 micrometers, preferably from about 20 to about 80 micrometers.

The jet stream medium may contain from about 1 to about 75 weight percent abrasive. More often, about 5 to about 50 weight percent, and preferably about 15 to about 30 weight percent is preferred.

In operation, the formulations are employed in a fashion which differs in a number of respects from jet stream polishing as practiced in the prior art and as familiar to those of ordinary skill in the art.

In the context of the present invention, the polymer formulation is sensitive to viscosity in two distinct regimes. First and foremost, the polymer must afford sufficient viscosity to effectively suspend the abrasive particles in the formulation, under low shear conditions, a parameter most closely defined by static viscosity. In addition, the formation of the jet stream, under high shear conditions, can substantially affect the coherence of the jet and the homogeneity of the abrasive particle dispersion in the jet. These parameters are defined by dynamic viscosity.

Although polymer solutions are non-Newtonian, they exhibit fluid behavior which approximates Newtonian fluids under static conditions. In addition, Newtonian fluid flow characteristics again predominate at high shear conditions.

The time for a spherical particle to settle through a given height under the force of gravity in a static fluid requires a particular time. Thus, from fluid mechanics, $$t = \frac{18\,h\,H}{a^2[D_P - D_L]g}$$

We have observed that the following assumptions, on which the foregoing formula is dependent, are sufficiently valid for the purposes of the present invention:

Laminar Flow: At very low velocities, characteristic of the settling of abrasive particles, flow characteristics are laminar or very nearly so.

Newtonian Fluid: Under nearly static conditions involved in particle settling, the polymer formulations are sufficiently fluid in character that substantially Newtonian flow characteristics are exhibited.

Spherical Particle Shape: The irregular shape of abrasive particles introduces some error, but because the average particles do not vary widely in their major and minor dimensions, and because over a substantial number of particles these variations tend to average out, the variation can be safely ignored in the present context.

Formulations suitable for use in the present invention will have low shear rate viscosity (Brookfield) on the order of about 75,000 to 500,000, preferably about 150,000 centipoise (cp). A 320 mesh SiC particle with a specific gravity of 3 will give a settling rate of $6.8\times10^6$ seconds per inch (approximately eleven weeks, and suitable for the present invention).

At higher shear rates, the behavior of polymer formulations becomes non-Newtonian, where viscosity is dependent on shear rate, in a Power Law relationship. This dependence holds until at a high shear rate, when viscosity again becomes substantially independent of applied shear, and substantially Newtonian flow characteristics again apply.

One of the particular virtues of the jet stream formulations of the present invention is the reduction in pressure required in the formation of the jet to produce effective polishing effects. Typically, the pressures required will be on the order of about 5 to about 80 MPa (about 750 to about 12,000 psi), compared to pressures of typically at least 200 MPa (30,000 psi) and higher in the prior art jet stream cutting operations.

As a convention, the pressure employed is measured as the pressure drop across the jet forming nozzle. As those of ordinary skill in the art will readily recognize, pressures of up to 80 MPa do not require the complex, expensive, and attention demanding equipment employed at pressures of 200 MPa and higher typically required in the prior art. Thus practice of the present invention require the employment of equipment equivalent in function to pressure compensated hydraulic pumps, high pressure intensifiers, and accumulators but the highly demanding engineering specifications required for jet stream cutting operations can be greatly simplified. The present invention can be practiced with readily available and inexpensive conventional positive displacement pumps, such as piston pumps, which may be hydraulically driven or the like at the pressures required.

At the nozzle orifice diameters effective in the present invention, nozzle velocities will range from about 75 to about 610 meters per second (about 250 to about 2,000 ft per second), preferably from about 150 to about 460 meters per second (about 500 to about 1,500 ft per second), which has proven to be fully effective in the practice of the present invention.

Selection of the abrasive material is not critical in the present invention, and any of the commonly employed materials will be effective. Examples of suitable materials include, for illustration, alumina, silica, garnet, silicon carbide, diamond, and the like. At higher viscosities it may be possible to use tungsten carbide, although it's density may pose problems in maintaining effective dispersion in the medium. The reuse of the polishing medium permits economic use of harder, but more expensive abrasives, with resulting enhancements in the efficiency of polishing and machining operations to increase the polishing rate when required. For example, silicon carbide may he substituted in polishing operations where garnet has been used.

In general, the abrasive will desirably be employed at concentrations in the formulation at levels of from about 3 to about 60 weight percent, preferably about 10 to about 30 weight percent. We have found that operation at the preferred range, and lower in some cases, is quite effective.

As noted above, the abrasive particles can range from 2 to 2,000 micrometers in their major dimension (diameter), preferably from about 20 to 200 micrometers. For surfaces where a fine surface finish is desired, particle sizes of from about 20 to about 100 micrometers are particularly advantageous. It will generally be appropriate to employ the smallest particle size consistent with the required polishing rate. It is preferred that the particle diameter or major dimension not exceed about 20% and preferably not exceed about 10% of the orifice diameter.

If the particle size is larger, there is a risk that "bridging" across the orifice will occur, plugging the flow through the nozzle, which is self-evidently undesirable. At particle sizes of less than 20%, bridging seldom occurs, and at less than 10% such effects are very rare. The nozzle shape and size is generally determined by other parameters.

In particular, the design of the nozzle orifice is determined by the divergent jet stream pattern desired. A number of nozzle designs for producing a variety of patterns of flow are known in the art, and those of ordinary skill in the art will be able to choose among them with no difficulty.

The orifice may be formed from hard metal alloys, hard facing materials such as tungsten or silicon carbide, ceramic formulations, or crystalline materials such as sapphire or diamond. The selection of suitable materials will ordinarily be determined by the hardness and particle size of the selected abrasive and the cost of the nozzle material. Diamond is preferred. Natural, compacted or synthetic diamond or "near diamond" film coatings may be employed.

The standoff distance, i.e., the distance between the nozzle and the workpiece surface, has proven to be an important factor in the quality of the surface finish attained, but is not nearly so important as in abrasive water jet cutting. The present invention is capable of polishing at standoff distances of up to about 25 to about 30 cm (about 10 to about 12 inches).

Jet stream polishing in accordance with the present invention can be employed to polish any of the materials for which such techniques have heretofore been employed. Notably, particularly materials which are difficult to machine, including many metals and alloys, such as stainless steels, nickel alloys, titanium, ceramics and glasses, rock materials, such as marble, granite and the like, are all effectively polished with considerable precision by the present techniques.

Among the benefits of the present invention, achieved using gel-thickened polymer media with abrasive material in suspension is the ability of the present invention to provide premixed suspensions of fine abrasive particle sizes not previously used. Abrasive particle sizes finer than about 200 micrometers, and particularly less than about 100 micrometers, for example, were not previously preferred. Use of such fine abrasive particles in conventional abrasive hydrodynamic jet stream polishing and machining tended to result in abrasive material clogging at angles, loops and sags in abrasive material feed lines, and such fine abrasive materials are also more difficult to introduce into jet streams in a conventional mixing chamber or mixing tube. Because of these difficulties, such small particle sizes have largely been avoided in the practice of abrasive jet stream polishing and machining.

Utilization of a premixed abrasive material suspension in the present invention eliminates the need for additional feed lines and equipment in the nozzle assembly. Fine abrasive particles improve polishing and machining quality and precision, and reduce abrasive particle damage to the workpiece surfaces adjacent the polishing area. Therefore, fine abrasive particles may be particularly useful in applications where additional finishing steps can be eliminated.

Having an essentially uniform suspension of abrasive materials and having abrasive particles moving at speeds comparable to those of the carrier medium, which is a consequence of using premixed abrasive material suspensions, significantly reduces the tendency for abrasive materials to bridge or pack at the nozzle orifice. Therefore, nozzle orifice diameters clan be reduced. Depending on abrasive particle size, nozzle orifice diameters can be as small as about 0.1 mm (about 0.004 in.). Such smaller orifices provide comparably smaller diameter jet streams enhancing polishing and machining precision by producing more finely selective polishing and decreasing media consumption rates.

Dispersions of the abrasive into the medium is achieved by simple mixing techniques, and is not narrowly significant to the practice of the invention.

As noted previously, the design and structure of the nozzle elements for use in the system of the present invention are greatly simplified by the elimination of the mixing tube, the abrasive feed mechanism, and the abrasive transport conduit, typically a hose. The features and their bulk, complexity, expense, weight and dependence on operator judgment and skill are all eliminated to the considerable benefit of abrasive jet stream polishing and machining operations.

It is also desirable that the specific design of the nozzle to be employed be configured to minimize the application of shear to the polymer constituent of the jet stream medium. It is accordingly preferred that the rate of change of the cross-sectional area of the nozzle from the relatively large inlet to the outlet of the nozzle orifice he developed in smooth, fair continuous curves, avoiding as much as possible the presence of edges or other discontinuities. Acceleration of the flow is achieved by reducing the cross sectional area through which the medium is pumped, and high shear stresses are necessarily applied to the polymer. It is believed, however, that chain scission and polymer degradation are minimized by avoiding stress concentrations at edges and the like, where the rate of change in the stress is very high, and proportional to abrupt changes in the rate of change of the cross sectional area.

Such features in the nozzle also serve to avoid producing turbulent flow in the medium. Coherence of the jet stream is favored by laminar flow through the nozzle orifice, so that the indicated nozzle configuration serves to limit and control divergence of the stream.

Minimizing induced shear stresses is helpful in the context of all aspects of the present invention. In particular, shear stress magnitudes sufficient to generate turbulent flow in passing media are to be avoided. Shear stresses of this magnitude for high velocity flow are associated with passage over discontinuities and edges. A consequence of such flow is generation of stress stresses in the media of sufficient magnitude to break polymer bonds. Breaking polymer covalent bonds with the attendant irreversible molecular weight reduction are all manifestations of polymer degradation, and are best avoided or minimized when possible.

As illustrated in FIG. 1, the operation of the polishing procedure of the present invention is represented quite simply in schematic form. Specific apparatus to perform the indicated operations and to practice the invention are individually known to those of ordinary skill in the art. In combination, a workpiece (10), having a surface (12) to be worked, having roughness (14) to be removed by polishing, is mounted in position so that the medium used to work on the workpiece is collected in a catchment, shown in FIG. 1 as an open top tank (30). The collected medium in tank (30) is pumped via conduit (32) through an optional but preferred filter (84), which removes large particles from the medium, and then through conduit (36) to pump (80). Pump (80) fills high pressure pump (66) by passing the medium into chamber (64), hounded by displacement piston (74), with its associated drive mechanism (70). When chamber (64) is full, displacement of piston (74) forces the medium at operating pressure to nozzle (20) via conduit (22), to form jet (24).

Figure 2:
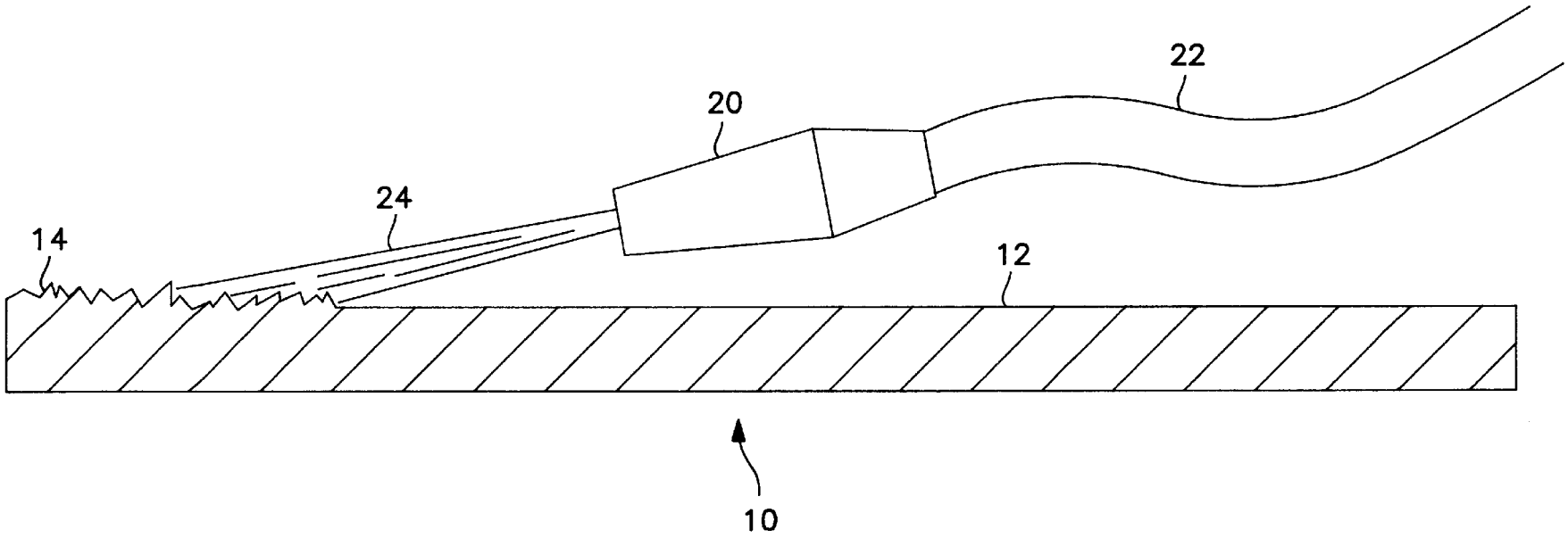
FIG. 2 is a stylized schematic view of a workpiece surface and a polishing jet stream showing the polishing action in accordance with the present invention.

In FIG. 2, a more detailed schematic view of the polishing operation is shown, where a workpiece (10), is exemplified in the Figure as a flat plate with polishing being performed on the upper surface (12) to remove roughness (14). In operation, a divergent flow nozzle (20) is supplied with the fluid jet stream medium via a suitable conduit (22). The medium is propelled through nozzle (20) to form a jet stream (24), which is projected against the rough surface (14) of the workpiece (10) at an angle of about 75° from a line normal to surface (12), to remove roughness (14). The other portions of the upper surface (12) are shown as smooth, as previously produced by the polishing action of the jet stream (24).

While the invention is illustrated in the drawings with regard to flat plate workpieces, the invention may be employed to polish and grind workpieces of any shape. As those of ordinary skill in the art will readily recognize, care must be taken when polishing at or near corners. As the operation is performed in the immediate vicinity of inside corners, it needs be recognized that deflection and overspray is likely to perform at least some work on the areas of the workpiece other than the specific area at which the jet stream is directed. When working at outside corners, it is important to recognize that points, edges and the like are more rapidly worked than flat areas and care must be taken to avoid excessive working of the surface at such locations.

Those of ordinary skill in the art will recognize, given the guidance of the present disclosure that the invention is not limited to the specific apparatus illustrated in the drawings, and that the components of the system employed may be selected from among a diverse and substantial number of parts which are familiar to the art. The specific embodiments shown in the drawings are selected for the clarity of illustration and for their simplicity, ready availability and low cost.

Performance of the present invention in polishing and grinding of surfaces of a number of materials has been demonstrated to be at least equal and often superior to the performance of prior art techniques. The greatest advantage of the system of the present invention stems from the capacity to collect, recycle and reuse the medium, typically for 20 to 100 cycles for many of the formulations. Another considerable advantage is the simplification of the equipment required for abrasive jet stream polishing and machining operations, operating at lower pressure. These features provide considerable cost savings, and reduce dependence on the skills and experience of operators of the equipment.

For a given abrasive particle size, we have also observed that the surface finish of the workpiece is rapidly brought to the same levels attainable with hand polishing techniques, but with far less labor and time. When coupled with the ability to use smaller particle sizes, it is possible to produce surface finishes which require no hand surface finishing procedures, reducing the number of operations and the amount of labor and equipment required in production. When used to break sharp edges and remove burrs, the technique is rapid, effective and readily controlled.

The polishing rates attained in the present invention vary with the conditions employed. Generally for a give material to be worked and a particular particle size

EXAMPLES

Examples 1 to 3

An aqueous solution of guar gum, at 40% by weight, is formed by mixing the gum and water at slightly elevated temperature, of about 35° C., for a period of about thirty minutes, until the gum is fully dissolved. To the solution thus formed, 0.60 weight percent of a high molecular weigh alkali deacetylated polysaccharide of mannose, glucose and potassium glucoiiurate acetyl-ester is added and dissolved. To that solution, an equal volume of an aqueous solution of 35 weight % boric acid and 2.0 weight % sodium borate is added and mixed until homogeneously blended, accompanied by the initiation of hydrogel formation.

To the forming hydrogel, 50 parts of SiC, having a particle size of 45 micrometers (325 mesh) is added, and the combined materials are thoroughly mixed until a homogeneous dispersion of the abrasive is achieved. The result is a friable powder hereafter referred to as a precursor concentrate.

The above precursor composition is generally utilized in a dry powder form and mixed with various percentages of water, depending upon the size of the nozzle orifice through which the medium must pass during jet stream polishing and machining, together with appropriate percentages of finely divided abrasive for polishing and machining. Preferably, but not necessarily, a minor amount of paraffin oil or hydrocarbon grease is added to the composition as a humectant to inhibit formation of crust upon the medium if it is not used immediately. The characteristics of suitable formulations by volume for different nozzle orifice sizes are listed below in Table I.

TABLE I

| Example | Orifice Size (mm) | Vol. % Water | Vol. % Oil | Abrasive | Nozzle Static Viscosity |
|---|---|---|---|---|---|
| 1 | 0.129 | 20–50 | 1–10 | 0–20 | 72,000 |
| 2 | 0.254 | 10–20 | 0–5 | 0–20 | 368,000 |
| 3 | 0.635 | 7–12 | 0–3 | 0–20 | 4,520,000 |

The oil component in the above-defined compositions not only delays or prevents crusting. It also controls tackiness. With little or no oil, the medium may be adherent to metal as well as the hands of the operator. A suitable humectant oil is, therefore, a preferred additive.

Sometimes, shelf life of the above media is limited to attack by bacterial or fungal growth. The addition of a very small amount of a biocide, such as methyl- or parahydroxybenzoate, typically in proportions of less than about 1%, and often less than about 0.5%, is often helpful to control such attack.

Examples 4 to 26

The following components were combined in a planetary mixer:

| Component | Parts By Weight |
|---|---|
| Polyborosiloxane | 35.0 |
| Stearic Acid | 21.5 |
| Light Turkey Red Oil | 8.5 |
| Hydrocarbon Based Grease | 35.0 |

The polyborosiloxane had a molecular weight of 125,000 and a ratio of Boron to Silicon of 1:25. The grease was an automotive chassis lubricating grease obtained from Exxon.

The components were mixed under ambient conditions until a smooth homogeneous blend was acheived, and was then divided into portions. Each portion was then combined and mixed with abrasive particles, as indicated in Table II, to form a plurality of abrasive jet stream media. Each formulation was adjusted by the addition of stearic acid to produce a standing viscosity of 300,000 cp.

Each of the media formulations was employed to polish aluminum plate under the conditions indicated in Table II, and the surfaces were evaluated.

TABLE II

| A | B | C | D | E | F | G | H | I |
|---|---|---|---|---|---|---|---|---|
| 4 | SiC | 40 | 220 | 0.020 | 1.6 | 3000 | 80 | 9.46 |
| 5 | SiC | 25 | 220 | 0.020 | 0.25 | 4000 | 80 | 9.46 |
| 6 | Garnet | 50 | 220 | 0.020 | 0.25 | 4000 | 80 | 9.46 |
| 7 | BC | 58 | 320 | 0.015 | 0.075 | 7200 | 80 | 9.46 |
| 8 | SiC | 58 | 320 | 0.015 | 0.075 | 7400 | 80 | 9.46 |
| 9 | SiC | 58 | 320 | 0.015 | 0.075 | 7200 | 80 | 9.46 |
| 10 | SiC | 58 | 320 | 0.020 | 0.75 | 7400 | 50 | 9.46 |
| 11 | SiC | 58 | 320 | 0.020 | 0.75 | 7400 | 60 | 9.46 |
| 12 | SiC | 58 | 320 | 0.020 | 0.75 | 7400 | 70 | 9.46 |
| 13 | SiC | 58 | 500 | 0.015 | 0.075 | 7100 | 87 | 9.46 |
| 14 | SiC | 58 | 500 | 0.020 | 0.075 | 7100 | 85 | 9.46 |
| 15 | SiC | 58 | 320 | 0.020 | 0.075 | 7100 | 80 | 9.46 |
| 16 | SiC | 58 | 320 | 0.020 | 0.075 | 7000 | 70 | 9.46 |
| 17 | SiC | 58 | 320 | 0.020 | 0.50 | 7200 | 70 | 9.46 |
| 18 | SiC | 58 | 320 | 0.020 | 1.00 | 7200 | 70 | 9.46 |
| 19 | SiC | 58 | 320 | 0.020 | 1.50 | 7200 | 70 | 9.46 |
| 20 | SiC | 58 | 320 | 0.020 | 0.075 | 7000 | 88 | 9.46 |
| 21 | SiC | 58 | 320 | 0.020 | 0.075 | 7000 | 80 | 9.46 |
| 22 | SiC | 25 | 320 | 0.012 | 0.50 | 9700 | 88 | 9.46 |
| 23 | SiC | 25 | 320 | 0.012 | 0.50 | 9700 | 85 | 9.46 |
| 24 | SiC | 25 | 320 | 0.012 | 0.50 | 9700 | 80 | 9.46 |
| 25 | SiC | 25 | 320 | 0.010 | 0.50 | 9700 | 75 | 9.46 |
| 26 | SiC | 25 | 320 | 0.008 | 0.50 | 9700 | 70 | 9.46 |

Legend
A = Example No.
B = Abrasive
C = Conc. (wt. %)
D = Mesh
E = Nozzle Dia., in [dn]
F = Stand-Off, in [SOD] Ratio
G = Pressure (psi)
H = Angle of Incidence, (deg.)
I = Initial Roughness Ra (μm)

As shown by Table II, a wide variety of conditions may be employed in the present invention. High quality polished surfaces were obtained, which varied with the abrasive mesh size and, to a lesser degree with the angle of incidence. All angles were measured relative to the normal to the surface of the plate.

Examples 27–62

The base formulation used in Examples 4–26 was again employed, and mixed with the abrasives set out in Table III; the viscosity was again adjusted with stearic acid to a resting viscosity of 300,000 cp, and the formulation was employed to polish aluminum plate. The polishing conditions are set out in Table III.

The characteristics of the polished surfaces of the plate were measured for surface roughness. The measured values are set out in columns G and H of Table III.

TABLE III

| A | B | C | D | E | F | G | H |
|---|---|---|---|---|---|---|---|
| 27 | SiC | 220 | 0.500 | 7300 | 5 | 53.15 | 1.35 |
| 28 | SiC | 220 | 0.500 | 7300 | 6 | 60.24 | 1.53 |
| 29 | SiC | 220 | 0.500 | 7300 | 7 | 53.94 | 1.37 |
| 30 | SiC | 220 | 0.500 | 7300 | 8 | 74.41 | 1.89 |
| 31 | SiC | 220 | 0.500 | 7300 | 9 | 72.05 | 1.83 |
| 32 | SiC | 220 | 0.500 | 7300 | 1 | 40.55 | 1.03 |
| 33 | SiC | 220 | 0.500 | 7300 | 1 | 50.00 | 1.27 |
| 34 | SiC | 320 | 0.075 | 7200 | 2 | 33.46 | 0.85 |
| 35 | SiC | 320 | 0.075 | 7200 | 2 | 46.46 | 1.18 |
| 36 | SiC | 320 | 0.075 | 7200 | 2 | 92.13 | 2.34 |
| 37 | SiC | 320 | 0.075 | 7200 | 2 | 62.99 | 1.60 |
| 38 | SiC | 320 | 0.075 | 7200 | 2 | 43.70 | 1.11 |
| 39 | SiC | 320 | 0.075 | 7000 | 2 | 32.28 | 0.82 |
| 40 | SiC | 320 | 0.075 | 7000 | 2 | 26.77 | 0.68 |
| 41 | SiC | 320 | 0.075 | 7000 | 2 | 27.56 | 0.70 |
| 42 | SiC | 320 | 0.500 | 7000 | 2 | 35.83 | 0.91 |
| 43 | SiC | 320 | 0.500 | 6000 | 2 | 53.54 | 1.36 |
| 44 | SiC | 320 | 0.500 | 5000 | 2 | 51.18 | 1.30 |
| 45 | SiC | 500 | 0.625 | 7650 | 2 | 49.61 | 1.26 |
| 46 | SiC | 500 | 0.625 | 7650 | 1 | 26.38 | 0.67 |
| 47 | SiC | 500 | 0.625 | 7650 | 1 | 52.36 | 1.33 |
| 48 | SiC | 500 | 0.625 | 7650 | 2 | 52.76 | 1.34 |
| 49 | SiC | 500 | 0.625 | 7650 | 3 | 113.78 | 2.89 |
| 50 | SiC | 500 | 0.075 | 7000 | 1 | 28.74 | 0.73 |
| 51 | SiC | 500 | 0.075 | 7000 | 1 | 22.83 | 0.58 |
| 52 | SiC | 500 | 0.075 | 7000 | 1 | 56.69 | 1.44 |
| 53 | SiC | 500 | 0.075 | 7000 | 1 | 62.60 | 1.59 |
| 54 | SiC | 500 | 0.075 | 7000 | 1 | 15.35 | 0.39 |
| 55 | SiC | 500 | 0.075 | 7000 | 1 | 28.35 | 0.72 |
| 56 | SiC | 500 | 0.075 | 7000 | 1 | 14.96 | 0.38 |
| 57 | SiC | 320 | 0.075 | 7300 | 2 | 82.68 | 2.10 |
| 58 | SiC | 320 | 0.075 | 7300 | 2 | 106.30 | 2.70 |
| 59 | SiC | 320 | 0.075 | 7300 | 2 | 145.67 | 3.70 |
| 60 | SiC | 320 | 0.075 | 7170 | 1 | 62.99 | 1.60 |
| 61 | SiC | 320 | 0.075 | 7170 | 1 | 68.50 | 1.74 |
| 62 | SiC | 320 | 0.075 | 7170 | 1 | 76.38 | 1.94 |

Legend
A = Example
B = Abrasive
C = Mesh
D = Stand-Off Distance (in)
E = Pressure (psi)
F = Feed Rate (in/min)
G = Initial Ra (μinch)
H = Finished Ra (μm)

As those of ordinary skill in the art will readily recognize, the surface finishes measured and reported in Table III are of exceptional quality.

The foregoing examples are intended to be illustrative of the present invention, and not limiting on the scope thereof. The invention is defined and limited by the following claims, which set out in particular fashion the scope of the invention.

What is claimed is:

1. A method of jet stream polishing and grinding the surfaces of a workpiece, comprising the steps of:

(A) forming a fluid jet stream medium, wherein said fluid jet stream medium comprises a particulate abrasive suspended in a viscous carrier medium;

(B) projecting said fluid jet stream medium at a surface of a workpiece at an angle of incidence at least about 45° from a line normal to said surface for a time and at a pressure sufficient to reduce roughness of said surface.

2. A method of jet stream polishing and grinding the surfaces of a workpiece, comprising the steps of:

(A) forming a fluid jet stream medium, wherein said fluid jet stream medium comprises a particulate abrasive suspended in a viscous carrier medium comprising a polymer having reformable sacrificial chemical bonds which are preferentially broken under high shear conditions;

(B) projecting said medium and suspended abrasive at said workpiece for a time and at a pressure sufficient to reduce roughness of said surface, to effect said polishing and grinding under shear conditions which break said reformable sacrificial chemical bonds;

C. reforming said chemical bonds; and

D. recycling said medium and said abrasive for reuse in the method.

3. The method of claim 2 wherein said medium is projected through an orifice to form a jet stream at a pressure of from about 5 to about 80 MPa.

4. The method of claim 3 wherein said jet stream is projected at a velocity of from about 200 to about 1,000 ft per second.

5. The method of claim 2 wherein said abrasive particles have a particle size of from about 2 to about 1,600 micrometers in their major dimension.

6. The method of claim 2 wherein said medium is an aqueous gel of a water soluble polymer ionically cross-linked with a compound of a Group II to Group VIII metal.

7. The method of claim 2 wherein said medium is a non-aqueous plasticized polymer which forms intermolecular bonds to form a gel.

8. The method of claim 2 wherein said gel has a static viscosity of from about 200,000 to 600,000 centipoise.

9. The method of claim 2 wherein said medium is an aqueous hydrogel of from about 1 to about 20 volume percent of a hydroxyl group containing water soluble polymer gelled by formation of intermolecular hydrogen bonds promoted by the action of a gelling promoter containing a metal from Group II to Group VIII.

10. The method of claim 9 wherein said water soluble polymer is a member selected from the group consisting of guar gum and its hydroxypropyl derivatives, cellulose derivatives including carboxymethylelhyl cellulose, or synthetic hydroxyl functional polymers including polyacrylamide and polyoxymethylene.

11. The method of claim 9 wherein said medium comprises from about 1 to about 20 volume percent of said water soluble polymer.

12. The method of claim 9 wherein said aqueous medium comprises from about 50 to about 75 weight percent of guar gum, from about 30 to about 40 weight percent of boric acid, and from about 1.0 to about 2.5 weight percent sodium borate.

13. The method of claim 9 further comprising adding up to 10 weight percent of a humectant oil to said aqueous hydrogel medium.

14. The method of claim 9 wherein a biocide is added to said aqueous hydrogel medium.

15. The method of claim 9 further comprising adding about 0.25 to 0.60 weight percent of a high molecular weight polysaccharide to said gelling promoter.

16. The method of claim 2 wherein said jet stream is formed by forcing said thickened aqueous medium through a nozzle means having an interior entry port surface and interior exit orifice surface with an interconnecting transition zone surface; all of said entry port surface, said transition zone surface and said exit orifice surface being in contact with said thickened aqueous medium passing through said nozzle means and said transition zone surface and said exit orifice surface defining a continuous function without discontinuities.

17. The method of claim 10 wherein up to 50 weight percent of said abrasive particles are added to said medium.

18. The method of claim 16 further comprising adding a soluble thixotrope for improved rheological behavior.

19. The method of claim 15 wherein said polysaccharide comprises the alkali deacetylated derivative acetyl ester of a polymer selected from the group consisting of mannose, glucose, potassium glucuronate, and mixtures thereof.

20. The method for jet stream polishing and grinding of claim 2 further comprising collecting said jet stream in a catching means after said jet stream has worked a workpiece, wherein said catching means comprises a containment vessel and a decelerating medium for decelerating said jet stream.

21. The method of claim 15 wherein said decelerating, medium comprises the same medium as used to form said jet stream.

22. The method of claim 16 wherein said decelerating medium and said decelerated medium are recycled for reuse as jet stream medium.

23. The method of claim 2 wherein the jet stream polishing medium comprises a non-aqueous plasticized cross-linked polymer gel, cross-Iii by intermolecular bonds, said medium having a static viscosity of from about 200,000 to about 600,000 centipoise.

24. The method of claim 23 wherein said abrasive particles have a maximum dimension of from about 2 to about 1,400 micrometers.

25. The method of claim 23 wherein said abrasive particles have a maximum dimension of from about 10 to 200 micrometers.

26. The method of claim 23 wherein said abrasive particles have a maximum dimension of from about 20 to about 100 micrometers.

27. The method of claim 23 wherein said medium has a viscosity at rest of about 300,000 cp.

28. The method of claim 23 wherein said polymer is a polyborosiloxane having boron-oxygen intermolecular cross-liking bonds.

29. The method of claim 28 wherein said polyborosiloxane has a molecular weight of from about 200,000 to about 750,000, and a boron—silicon atomic ratio of from about 10 to about 100.

* * * * *